US008061889B2

(12) United States Patent
Mattson et al.

(10) Patent No.: US 8,061,889 B2
(45) Date of Patent: Nov. 22, 2011

(54) ADJUSTABLE UNIVERSAL MIXER BRACKET

(75) Inventors: Barry W. Mattson, Elk River, MN (US); James C. Schroeder, Ramsey, MN (US)

(73) Assignee: Graco Minnesota Inc., Minneapolis, MN (US)

( * ) Notice: Subject to any disclaimer, the term of this patent is extended or adjusted under 35 U.S.C. 154(b) by 841 days.

(21) Appl. No.: 12/151,379

(22) Filed: May 6, 2008

(65) Prior Publication Data

US 2009/0277975 A1 Nov. 12, 2009

(51) Int. Cl.
*B01F 7/16* (2006.01)

(52) U.S. Cl. ..... 366/194; 366/282; 366/285; 366/286

(58) Field of Classification Search ..... 239/149, 239/289, 144, 147; 366/65, 194, 281–282, 366/284–285, 331, 286
See application file for complete search history.

(56) References Cited

U.S. PATENT DOCUMENTS

| | | | | | |
|---|---|---|---|---|---|
| 589,084 | A | * | 8/1897 | Hart et al. | 68/125 |
| 621,071 | A | * | 3/1899 | Grannell | 366/65 |
| 835,960 | A | * | 11/1906 | Leaver | 366/270 |
| 838,467 | A | * | 12/1906 | Shaw | 366/286 |
| 1,034,244 | A | * | 7/1912 | Johnson et al. | 366/286 |
| 1,111,715 | A | * | 9/1914 | Hood | 366/285 |
| 1,693,170 | A | * | 11/1928 | Alsop | 416/199 |
| 1,703,099 | A | * | 2/1929 | Craddock | 366/282 |
| RE17,683 | E | * | 5/1930 | Hood | 366/286 |
| 2,209,287 | A | * | 7/1940 | Simpson | 366/296 |
| 2,376,722 | A | * | 5/1945 | Podell | 366/282 |
| 2,625,720 | A | * | 1/1953 | Ross | 222/318 |
| 2,660,415 | A | * | 11/1953 | Hawes | 366/28 |
| 2,787,449 | A | * | 4/1957 | McElroy | 366/343 |
| 2,854,202 | A | * | 9/1958 | Blume, Jr. et al. | 248/661 |
| 3,068,186 | A | * | 12/1962 | Paulus et al. | 523/315 |
| 3,223,389 | A | * | 12/1965 | Simmonds | 366/282 |
| 3,617,382 | A | * | 11/1971 | Natsis et al. | 127/15 |
| 4,095,287 | A | * | 6/1978 | Felser et al. | 366/194 |
| 4,396,291 | A | * | 8/1983 | Simmonds | 366/282 |
| 4,416,549 | A | * | 11/1983 | Kretschmer | 366/190 |
| 4,452,536 | A | * | 6/1984 | Hinkle | 366/47 |
| 4,506,982 | A | * | 3/1985 | Smithers et al. | 366/19 |
| 4,802,141 | A | * | 1/1989 | Stegemoeller et al. | 366/132 |

(Continued)

FOREIGN PATENT DOCUMENTS

DE 3705827 A1 * 9/1988

(Continued)

OTHER PUBLICATIONS

Official Search Report and Written Opinion of the Patent Cooperation Treaty in counterpart foreign Application No. PCT/US2009/042969, filed May 6, 2009.

*Primary Examiner* — David Sorkin
(74) *Attorney, Agent, or Firm* — Kinney & Lange, P.A.

(57) ABSTRACT

A mixer mount for mounting a mixer to a sprayer cart includes a mixer clamp, a mixer bracket mount, a mixer bracket pivot and a support assembly. The mixer clamp is connected to the mixer bracket mount. The mixer bracket mount is connected to a mixer bracket pivot at a pivot point. The mixer bracket pivot slidably engages in the support assembly so that the distance between the mixer clamp and the support assembly may be changed. The support assembly is capable of connecting to a sprayer cart.

14 Claims, 3 Drawing Sheets

U.S. PATENT DOCUMENTS

| | | | | |
|---|---|---|---|---|
| 5,026,168 | A * | 6/1991 | Berryman et al. | 366/171.1 |
| 5,094,542 | A * | 3/1992 | Engels et al. | 366/282 |
| 5,634,717 | A * | 6/1997 | Fraczek et al. | 366/262 |
| 5,645,379 | A * | 7/1997 | Stoner et al. | 406/67 |
| 6,116,769 | A * | 9/2000 | DeWall | 366/43 |
| 6,135,630 | A * | 10/2000 | O'Neill | 366/281 |
| 6,161,954 | A * | 12/2000 | DeWall | 366/43 |
| 6,290,386 | B1 * | 9/2001 | Baumgartl et al. | 366/160.1 |
| 6,447,157 | B1 * | 9/2002 | Running et al. | 366/251 |
| 6,749,331 | B1 * | 6/2004 | Hughes | 366/191 |
| 6,752,527 | B2 * | 6/2004 | Galletti | 366/66 |
| 2003/0200998 | A1 | 10/2003 | Hoenisch et al. | |
| 2005/0259511 | A1 * | 11/2005 | Orton | 366/285 |
| 2006/0240546 | A1 * | 10/2006 | Goodwin et al. | 435/289.1 |
| 2006/0270036 | A1 * | 11/2006 | Goodwin et al. | 435/395 |
| 2006/0280028 | A1 * | 12/2006 | West et al. | 366/331 |
| 2007/0084946 | A1 | 4/2007 | Neville | |

FOREIGN PATENT DOCUMENTS

| | | | |
|---|---|---|---|
| JP | 4315656 | A | 11/1992 |
| JP | 06166019 | A * | 6/1994 |
| WO | WO8601767 | A1 | 3/1986 |

* cited by examiner

ADJUSTABLE UNIVERSAL MIXER BRACKET

BACKGROUND

A texture sprayer assembly is used to apply texture materials, such as plasters, fillers and decorative materials to walls, ceilings and other surfaces. A texture sprayer assembly typically includes a pump and a hopper mounted on a cart. Texture materials are fed from the hopper to the pump. The output of the pump is connected to an application device by a hose.

Texture materials are available as a premixed mud or as a dry powder. The premixed mud may be added directly to the hopper, while the dry powder must be premixed with water before being added to the hopper. Prior to application, the texture material is mixed with a standard hand-held mixer in the hopper to create a uniform mixture. During the mixing process, a user inserts the hand-held mixer into the hopper. The user must support and direct the mixer during use. After mixing, the user must remove the mixer from the hopper.

SUMMARY

A texture sprayer includes a mixer mount for mounting a mixer to a sprayer cart. The mixer mount includes a mixer clamp, a mixer bracket mount, a mixer bracket pivot and a mixer support assembly. The mixer clamp connects to the mixer bracket mount. The mixer bracket mount connects to the mixer bracket pivot at a pivot point so that the mixer bracket mount and the mixer clamp can pivot about the mixer bracket pivot. The mixer bracket pivot slidably engages in the mixer support assembly so that the distance between the mixer clamp and the mixer support mount may be adjusted. The mixer support assembly is capable of connecting to a sprayer cart.

DETAILED DESCRIPTION

Figure 1:
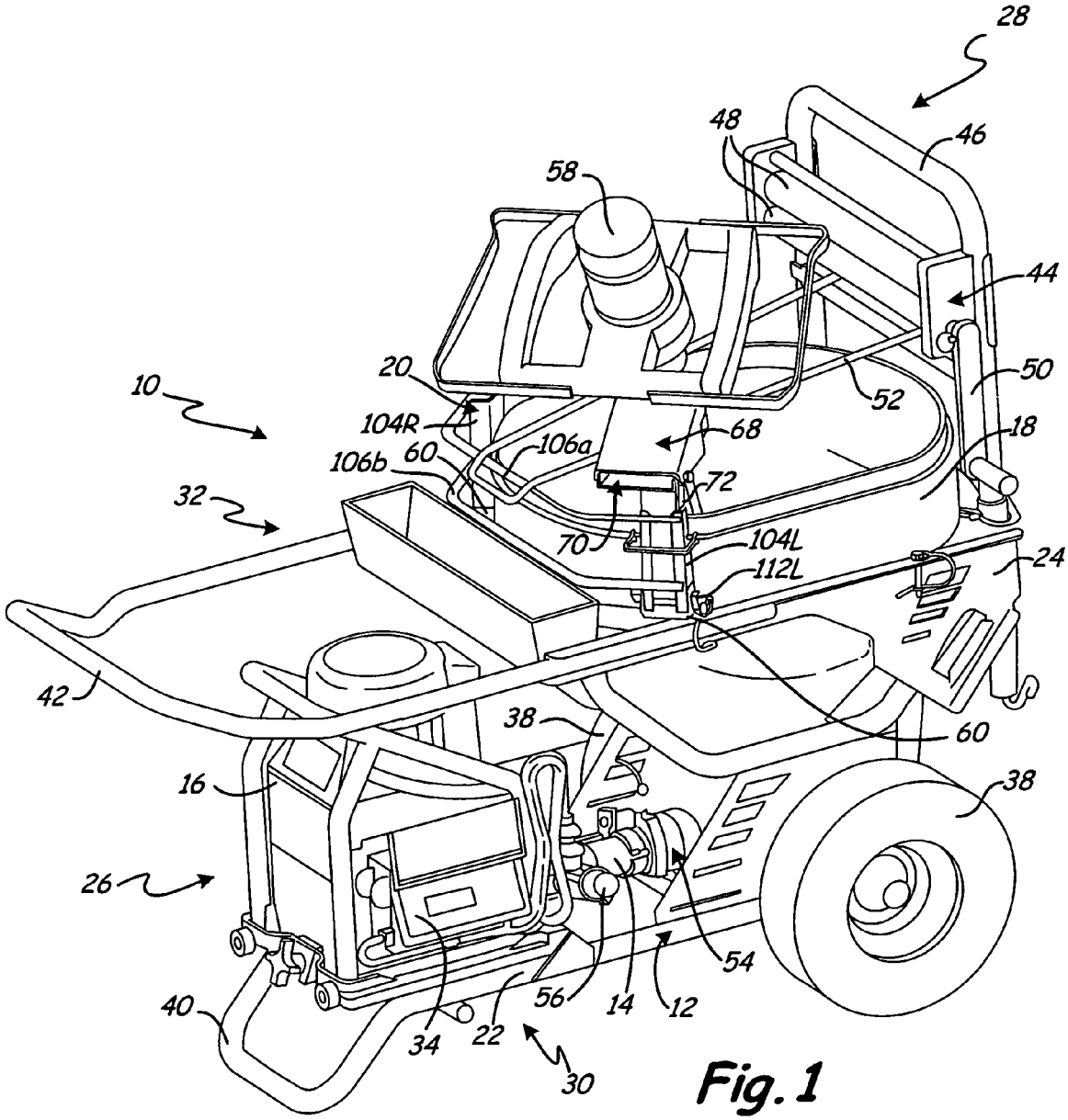
FIG. 1 is a perspective view of a texture sprayer assembly.

FIG. 1 is a perspective view of texture sprayer assembly 10, which includes cart 12, pump 14, motor 16, hopper 18, and adjustable mixer bracket 20. Cart 12 includes lower support frame 22 and upper support frame 24. For convenience, cart 12 will be referred to as having has back side 26, front side 28, left side 30 and right side 32. Lower support frame 22 supports motor 16 and pump 14. Motor 16 is located on back side 26 and is connected to control box 34, which controls motor 16. Wheels 38 support lower frame 22 on front side 28, and allow cart 12 to be moved. Cart rest 40 supports cart 12 on back side 26, and prevents cart 12 from tipping over or rolling away.

Upper frame 24 is supported by lower frame 22. Upper frame 24 supports handle 42, bag assembly 44, hopper 18 and adjustable mixer bracket 20. Handle 42 extends to back side 26 of cart 12. By lifting up on handle 42 so that cart rest 40 is off the ground, the user places the weight of assembly 10 on wheels 38 and may roll assembly 10 on wheels 38.

Bag assembly 44 is connected to front side 28 of cart 12 and includes upright bag assembly support 46, rollers 48, bag roller handle 50 and bag support 52. Rollers 48 connect to upright bag assembly support 46. Bag roller handle 50 is connected to rollers 48 so that when handle 50 is turned, rollers 48 turn. Bag support 52 connects to upright bag assembly support 46 below rollers 48, and extends across hopper 18 to rest on adjustable mixer bracket 20.

Bag assembly 44 assists the user in emptying bags of premixed mud texture material. In use, a bag of premixed mud is placed on bag support 52. One end of the bag is opened, and the opposite end of the bag is fed through rollers 48. As the user turns bag roller handle 50, the bag is pulled through the rollers 48, which squeeze the premixed mud from the bag and into hopper 18.

Hopper 18 is located at front side 28 of cart 12 and is supported by upper frame 24. Hopper 18 holds texture material, such as plaster, fillers and decorative materials. Hopper 18 may be made of plastic and may be any shape. In one example, hopper 18 is an oblong.

A portion of hopper 18 extends above the top of upper frame 24 of cart 12, and a portion of hopper 18 extends below the top of upper frame 24, as is shown in FIG. 1. Hopper 18 is designed so that different capacity hoppers may be used on the same cart 12. In order to fit the same cart, the portion of hopper 18 below the top of upper frame 24 remains the same while the height of the hopper extending above upper frame 24 changes. A hopper with a larger capacity will extend farther above upper frame 24 than a hopper with a smaller capacity.

Hopper 18 has hopper outlet 54 connected to pump 14. Hopper 18 feeds the texture material to pump 14. Pump outlet 56 is connected to an application device by a hose (not shown) so that the texture material may be applied to walls, ceilings and other surfaces.

Adjustable mixer bracket 20 attaches to upper frame 24 by brackets 60, which are mechanically fastened to upper frame 24. In one example, brackets 60 are welded to upper frame 24. Mixer bracket 20 is located on the back side of hopper 18 and follows the perimeter of hopper 18. Mixer bracket 20 rigidly holds mixer 58 in hopper 18 to mix the texture material.

Figure 2:
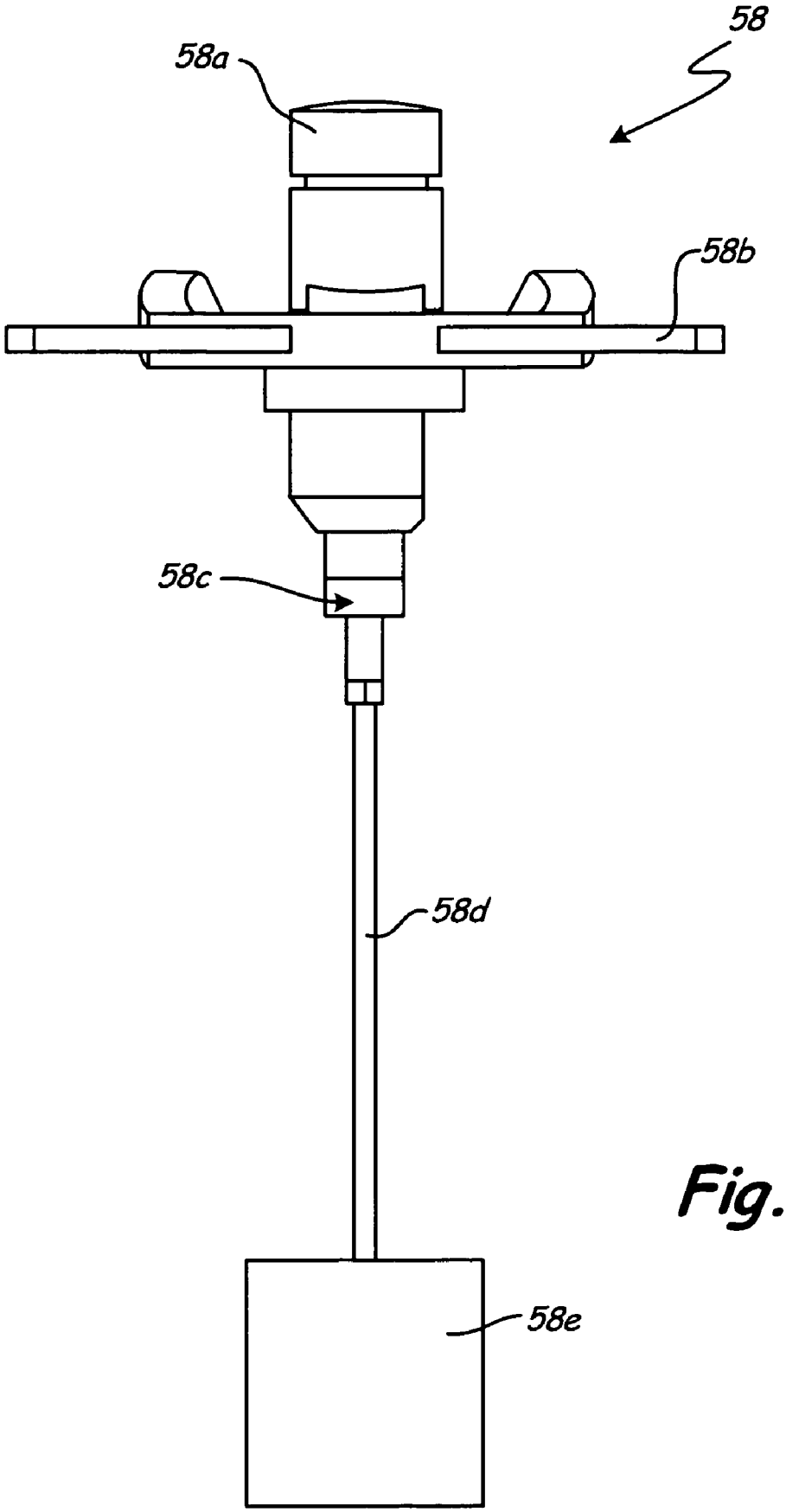
FIG. 2 is a schematic diagram of a standard hand-held mixer for texture materials.

FIG. 2 shows a standard hand-held mixer 58, which has mixer head 58*a*, handles 58*b*, sleeve 58*c*, shaft 58*d* and blade 58*e*. Sleeve 58*c* is a standardized feature on hand-held mixers, and is located at the bottom of mixer head 58*a*. Sleeve 58*c* is about 2 inches (5.08 cm) in diameter. The length of shaft 58*d* for hand-held mixers has not been standardized and may vary. In one example, shaft 58*d* may be about 25 inches (63.5 cm) in length. Although no specific blade is shown, blade 58*e* may be any style blade that is known in the art. For example, blade 58*e* may be a paddle or an auger style blade.

Figure 3:
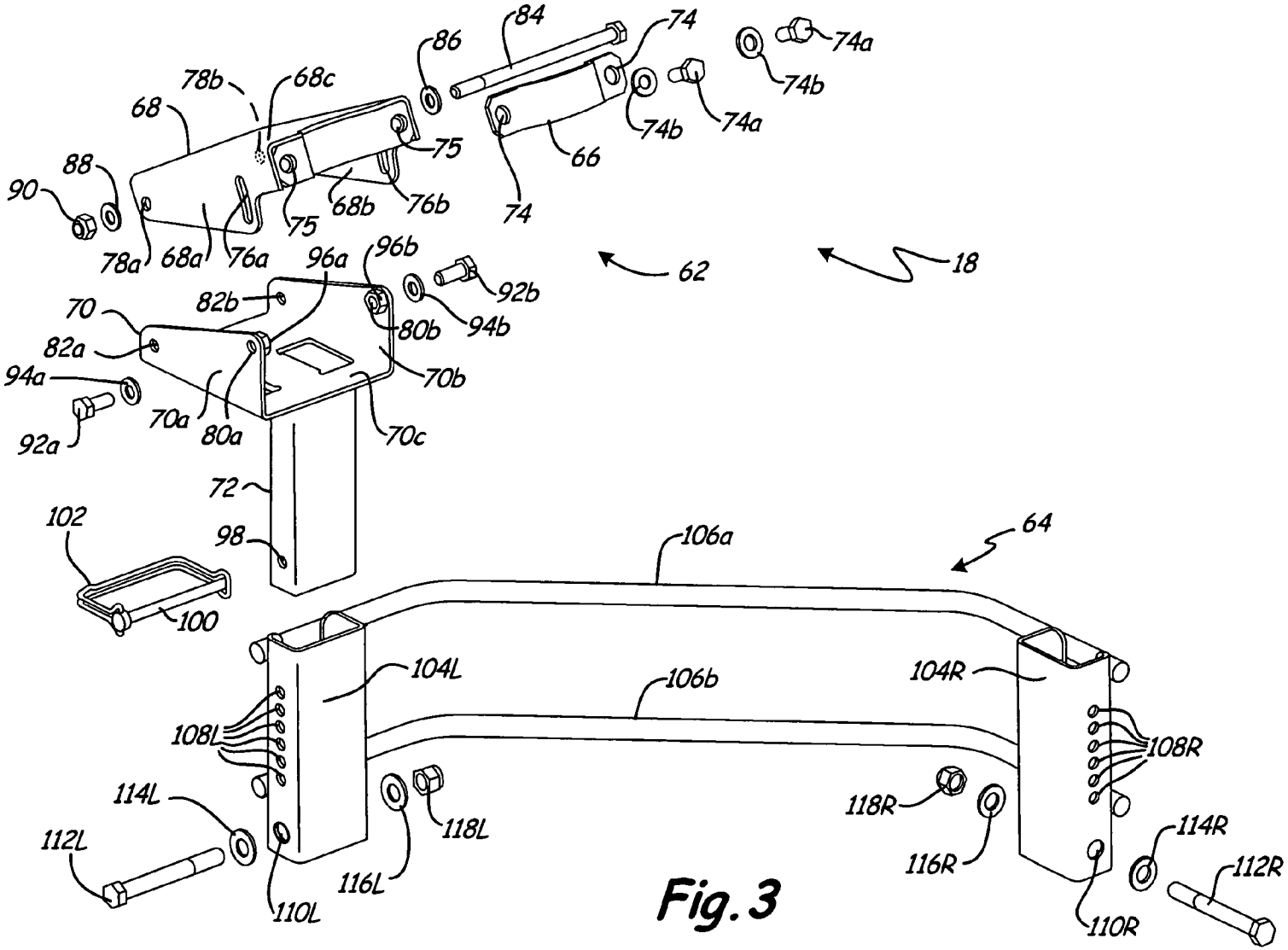
FIG. 3 is an exploded view of a mixer bracket.

FIG. 3 is an exploded view of mixer bracket 20, which includes clamping assembly 62 and support assembly 64. Clamping assembly 62 slidably engages in support assembly 64 so that clamping assembly 62 may be removed from support assembly 64 for storage, cleaning, transportation or relocation.

Clamping assembly 62 includes mixer clamp 66, mixer bracket mount 68, mixer bracket pivot 70, mixer bracket tube 72, bolts 74*a*, 84, 92*a* and 92*b*, washers 74*b*, 86, 88, 94*a*, and 94*b* and nuts 77*c*, 90, 96*a* and 96*b*. Nuts 77*c*, 96*a* and 96*b* are welded nuts. That is, for example, nuts 77*c* are welded to mixer bracket 68 so that only one wrench is necessary to tighten bolds 74*a*. nuts 96*a* and 96*b* function in a similar manner.

Mixer clamp 66 is mechanically fastened to mixer bracket mount 68, such as by bolts 74*a* through holes 74 and 75. Mixer bracket mount 68 is formed so that when mixer clamp 66 is attached, about a 2 inch (5.08 cm) diameter circular aperture is formed between mixer bracket mount 68 and mixer clamp 66. In use, sleeve 58*c* of mixer 58 is placed between mixer clamp 66 and mixer bracket mount 68. Sleeve 58*c* with a 2 inch diameter is standard on hand-held mixers. Therefore, a 2 inch (5.08 cm) diameter circular aperture allows mixer bracket 18 to be used with any standard hand-held mixer.

Mixer bracket mount 68 connects to mixer bracket pivot 70. Mixer bracket mount 68 is a U-shaped metal plate, having left side 68*a*, right side 68*b* and top 68*c*. Front left pivot slot 76*a*, front right pivot slot 76*b*, back left pivot hole 78*a* and back right pivot hole 78*b* are formed in mixer bracket mount 68.

Mixer bracket pivot 70 is also a U-shaped metal plate. Mixer bracket pivot 70 has left side 70*a*, right side 70*b* and bottom 70*c*. Front left pivot hole 80*a*, front right pivot hole 80*b*, back left pivot hole 82*a* and back right pivot hole 82*b* are formed in mixer bracket pivot 70.

Mixer bracket mount 68 and mixer bracket pivot 70 are connected in the back by pivot bolt 84, which extends through back pivot holes 78*b*, 82*b*, 82*a* and 78*a*. Mixer bracket mount 68 and mixer bracket pivot 70 are also connected in the front. On the left side, bolt 92*a* extends through front left pivot slot 76*a* of mixer bracket mount 68 and front left pivot hole 80*a* of mixer bracket pivot 70. Similarly on the right side, bolt 92*b* extends through front right pivot slot 76*b* and front right pivot hole 80*b*. Bolts 92*a* and 92*b* may be tightened at any location along pivot slots 76*a* and 76*b*, respectively. In this way, mixer bracket mount 68 pivots about pivot bolt 84. In one example, mixer bracket mount 68 can pivot between about 18 degrees and about 30 degrees from horizontal, giving a range of motion of about 12 degrees.

Pivoting mixer bracket mount 68 also pivots mixer clamp 66, and therefore pivots mixer 58, which is held by mixer clamp 66. Pivoting mixer 58 allows adjustable mixer bracket 20 to accommodate mixers with different length shafts. The pivoting also allows a user to adjust the location of blades 58*e* (and therefore the mixing) in hopper 18.

Mixer bracket tube 72 extends from mixer bracket pivot 70. Mixer bracket tube 72 may be a formed metal tube with a rectangular cross-section. Pin hole 98 is formed through mixer bracket tube 72 so that pin 100 may be inserted through pin hole 98 and locked in place with retainer 102.

Clamping assembly 62 slidably engages in support assembly 64. Support assembly 64 includes pockets 104L and 104R and rails 106*a* and 106*b* (referred to generally as pockets 104 and rails 106, respectively). Pockets 104 are formed metal tubes with a rectangular cross-section. Rails 106 are formed metal tubes or rods having a circular cross-section. Rails 106 extend between pocket 104L and 104R. Rails 106 provide support to pockets 104, and may be formed to mirror the shape of hopper 18.

Pockets 104L and 104R have pin holes 108L and 108R and holes 110L and 110R, respectively. Holes 110L and 110R connect pockets 104L and 104R to cart 12 so that support assembly 64 partially surrounds hopper 18, as shown in FIG. 1. Pocket 104L is placed in bracket 60 on upper frame 24, and hole 110L is aligned with holes formed in bracket 60. Bolt 112L is inserted through the holes and keeps pocket 104L in place. Pocket 104R is similarly formed and bolt 112R is inserted through hole 110R and bracket 60. When support assembly 64 is attached to cart 12, rails 106 follow the perimeter of a portion of hopper 18. Brackets 60 may be added to any new or existing cart for connecting support assembly 64.

Pockets 104 are formed so that the inner cross-sectional area of each pocket 104 is larger than the outer cross-sectional area of mixer bracket tube 72. As a result, mixer bracket tube 72 may be inserted into either pocket 104L or 104R. Mixer bracket tube 72 slidably engages in pockets 104, so that mixer bracket tube 72 may be removed from pocket 104 for storage, transportation, cleaning or to change pockets.

Having pockets 104L and 104R allows mixer bracket tube 72 (and therefore, mixer 58) to be placed at two alternative locations (left and right sides) on cart 12. This allows the user to place mixer 58 at the best location for a given application or according to the user's preference.

A series of pin holes 108L are formed in pocket 104L. Pin hole 98 in mixer bracket tube 72 is aligned with one pin hole 108L. Pin 100 is inserted through holes 98 and 108L. Pin 100 is held in place with retainer 102. The series of pin holes 108L allow mixer bracket tube 72 to be connected to pocket 104L at various locations along pocket 104L. This allows the distance between mixer clamp 74 (and mixer head 58*a*) and hopper 18 to be adjusted. This is also referred to as changing the height of clamp assembly 62. In one example, six pin holes 108L are formed in pocket 104L, with 0.45 inches (1.14 cm) center-to-center between the holes. Therefore, 2.25 inches (5.72 cm) of height adjustment is possible. Pocket 104R is constructed similarly.

Pin 100 and retainer 102 allow pin 100 to be inserted and removed without the use of tools. Therefore, it is quick and easy to connect and disconnect mixer bracket tube 72 and pockets 104, increasing the user's productivity.

Pin 100 may also be used as a stop for mixer bracket tube 72. For example, pin 100 may be inserted through pin hole 108L in pocket 104L, and then mixer bracket tube 72 may be inserted into pocket 104L so that mixer bracket tube 72 rests on pin 100. This arrangement also allows the height of mixer head 58*a* to be adjusted. Because mixer bracket tube 72 and pocket 104L are not securely fastened together, this arrangement is most useful when the texture sprayer assembly 10 is not being transported.

The adjustable height feature of adjustable mixer bracket 20 allows adjustable mixer bracket 20 to be used with different height hoppers. Depending on the capacity needed, different sized hoppers may be used in texture sprayer assembly 10. As explained above, a larger capacity hopper extends further above cart 12 than a smaller capacity hopper. Therefore, in order to hold mixer 58 in hopper 18, mixer clamp 74 must be farther away from cart 12 for a larger capacity hopper than for a smaller capacity hopper. That is, mixer bracket assembly 20 must be taller for a larger capacity hopper than for a smaller capacity hopper. The adjustable height of mixer bracket assembly 20 assures that mixer clamp 72 will be tall enough to clear the wall of hopper 18, and that mixer 58 may be placed at the desired location in hopper 18 regardless of what capacity hopper is used.

The adjustable height of mixer mounting bracket 20 also allows the user to adjust the location of blades 58*e* in hopper 18. By adjusting the location of blades 58*e*, the user can achieve uniform mixing in hopper 18.

Additionally, the adjustable height of mixer mounting bracket 20 allows adjustable mixer bracket 20 to accommodate mixers with different length shafts 58*d*. Mixers on the market today do not have a standardized shaft length 58*d*. For example, shaft length 58*d* may be about 25 inches (63.5 cm). The adjustable height of mixer mounting bracket 20 allows different mixers to be used in texture sprayer assembly 10.

Adjustable mixer bracket 20 prevents damage to hopper 18 and requires less operator attention during mixing. Previously, the user held and directed mixer 58 in hopper 18 during mixing. Typically blades 58*e* are metal while hopper 18 may be plastic. Therefore, hopper 18 may be damaged if contacted with blades 58*e*. Adjustable mixer bracket 20 rigidly holds mixer 58 in one place without operator attention, assuring that mixer 58 will not accidentally contact hopper 18.

Adjustable mixer bracket 20 allows the user to move away from hopper 18 or perform other tasks while mixer 58 is in hopper 18. Previously, mixer 58 was removed from hopper 18 when not in use. Adjustable mixer bracket 20 allows the user to leave mixer 58 in hopper 18, even the user is not present. Additionally, the user may move away from hopper 18 during mixing if mixer 58 has a lock-on feature. Thus, increasing the productivity of the user.

Adjustable mixer bracket 20 results in more uniform mixing. Adjustable mixer bracket 20 allows the user to adjust the height and angle of mixer 58 in hopper 18 to achieve optimum mixing. Further, adjustable mixer bracket 20 maintains mixer 58 in the optimum position. The user no longer has to personally physically maintain mixer 58 in the optimum position during the mixing process.

Additionally, the user may remove mixer 58 for storage or cleaning, and later re-insert mixer 58 without disturbing the adjusted height and angle positions. Similarly, the user may remove and re-insert clamping assembly 62 without disturbing the adjusted angle position.

Adjustable mixer bracket 20 holds standard hand-held mixer 58. Hand-held mixers have been standardized to include sleeve 58*c* below mixer head 58*a*. However, the length of shaft 58*d* may vary. Adjustable mixer bracket 20 accommodates a variety of shaft lengths by allowing the user to adjust the height and angle of mixer 58.

Although the present invention has been described with reference to preferred embodiments, workers skilled in the art will recognize that changes may be made in form and detail without departing from the spirit and scope of the invention.

The invention claimed is:

1. A sprayer for application of texture materials, the sprayer comprising:

a cart;

a hopper mounted to the cart and configured to contain texture material;

a pump connected to the hopper so as to be able to pump texture material from the hopper;

a first pocket mounted to the cart at a first location;

a tube insertable into the first pocket for slidable engagement with the first pocket;

a mixer bracket mount connected to the tube such that a height of the mixer bracket mount above the first pocket is adjustable by sliding the tube in the first pocket; and a mixer clamp connected to the mixer bracket mount, wherein the mixer clamp holds a mixer to position the mixer to mix texture material in the hopper.

2. The sprayer of claim 1, wherein the mixer clamp is pivotable so that an angle between the hopper and the mixer clamp may be changed.

3. The sprayer of claim 2, wherein the angle between the hopper and the mixer clamp is between about 18 degrees and 30 degrees.

4. The sprayer of claim 2, wherein a distance between the hopper and mixer clamp is adjustable by sliding the tube along the first pocket.

5. The sprayer of claim 4, wherein the distance may be changed by about 0.45 inches to about 2.25 inches.

6. The sprayer of claim 2 and further comprising:

a mixer bracket pivot coupled to the tube, the mixer bracket pivot including a pivotable connection with the mixer bracket mount such that the mixer clamp is pivotable with respect to the tube.

7. The sprayer of claim 1 and further comprising:

a second pocket fastened to the cart at a second location so that the tube and mixer bracket mount may be placed at two alternative locations on the cart.

8. The sprayer of claim 1, wherein the mixer bracket mount is removable without tools.

9. A spray cart for application of texture materials, the spray cart comprising:

a cart;

a hopper mounted to the cart and configured for containing texture material;

a pump connected to the hopper so as to be configured to pump texture material from the hopper;

a mixer configured for mixing texture material in the hopper, the mixer having a mixer head and a shaft; and a mixer clamping assembly connected to the cart, the mixer clamping assembly including:

a pocket fixedly coupled to the cart;

a tube slidably engaged with the pocket;

a mixer bracket pivot fixedly coupled to the tube;

a mixer bracket mount pivotably coupled to the mixer bracket pivot; and a mixer clamp connected to the mixer bracket mount and holding the mixer.

10. The spray cart of claim 9, wherein the mixer is pivotable about a pivot point between the mixer bracket pivot and the mixer bracket mount so that an angle of the shaft with respect to the tube may be changed.

11. The spray cart of claim 10, wherein the mixer may be pivoted about 12 degrees.

12. The spray cart of claim 9, wherein the mixer bracket mount is adjustable so that a distance between the mixer clamp and the hopper may be changed by sliding the tube in the pocket.

13. The sprayer cart of claim 12, wherein the distance is changeable by up to about 2.25 inches.

14. The sprayer of claim 6 wherein:

the mixer bracket mount comprises a first U-shaped metal plate to which the mixer clamp is secured; and the mixer bracket pivot comprises a second U-shaped metal plate joined to the first U-shaped metal plate at pivot holes such that the first U-shaped metal plate rotates with respect to the first U-shaped metal plate.

* * * * *